United States Patent [19]

Arnout et al.

[11] Patent Number: 5,002,261

[45] Date of Patent: Mar. 26, 1991

[54] CUTTING TORCH FOR IRON AND STEEL METALLURGY

[75] Inventors: Michel Arnout, Franconville; Didier Lasnier, Cergy; Eric Dufour, Le Pleassis Bouchard, all of France

[73] Assignee: L'Air Liquide, Societe Anonyme pour l'Etude et l'Exploitation des Procedes Georges Claude, Paris, France

[21] Appl. No.: 462,069

[22] Filed: Jan. 8, 1990

[30] Foreign Application Priority Data

Jan. 10, 1989 [FR] France ..... 89 00199

[51] Int. Cl.[5] ..... B23K 7/08

[52] U.S. Cl. ..... 266/74; 266/48

[58] Field of Search ..... 266/48, 74; 148/9 R

[56] References Cited

U.S. PATENT DOCUMENTS 4,455,176 6/1984 Fuhrhop ..... 266/48

4,830,681 5/1989 Arnout et al. ..... 266/48

*Primary Examiner*—S. Kastler

*Attorney, Agent, or Firm*—Curtis, Morris & Safford

[57] ABSTRACT

The invention concerns a cutting torch for iron and steel metallurgy which is provided with two oxygen cutting ducts, ending in two housings, for receiving two cutting inserts, or a heating nozzle and a cutting insert. In this manner, there is obtained a torch which may very rapidly be converted into a cutting torch with high heating capacity and single cutting jet, or into a cutting torch with high cutting speed provided with two cutting inserts.

14 Claims, 3 Drawing Sheets

CUTTING TORCH FOR IRON AND STEEL METALLURGY

BACKGROUND OF INVENTION (a) Field of the Invention

This invention relates to a cutting torch for iron and steel metallurgy.

(b) Description of Prior Art

Cutting torches currently used in the field of iron and steel metallurgy for the oxycutting of high thicknesses under heat, or for cold slitting, are generally made of a single material, copper, with a central jet of oxygen and most of them are provided with two heating crowns which concentrically surround the jet of oxygen.

French Patent No. 86.11.008 proposes a new concept of injectors for feeding oxygen to the central heating crown and suggests to make this cutting torch in two parts, thereby permitting to optimize the speeds of exit of the heating gases, while presenting the user with the advantage of only changing the cutting block if something takes place which causes a deterioration of the visible part of the torch.

As previously indicated, the most currently used technology in the designing of cutting torches for high thicknesses is the double heating crown which is concentrically disposed around a central jet of oxygen with an outer crown, in which the flame is very oxydizing, enabling to heat the top of the slab intended to be oxycut, and a heating crown located between the outer crown and the central cutting jet, with highly carburizing flame, to give a long wreath around the cutting jet, the wreath being carried by the cutting jet and penetrating the groove cutting in assisting and heating the middle and bottom part of the groove.

For the jet of oxygen, the so called Laval tuyère is the most currently used to give a high speed of exit without splitting of the jet.

However, the use of a single cutting jet operating at very high speed, and consequently at very high pressure, is limited since it may contribute to produce insufficient heating in the middle part of the groove, which, particularly when cold oxycutting, produces erosions which are detrimental to the quality of the cut.

This is the reason why French patent 87.04.523 has proposed a torch for oxycutting comprising two oxygen cutting jets, between which there is a central duct for a carburizing heating flame, ensuring a resumption of heating in depth in the rough groove cut, which has been produced by the first jet of oxygen and which is terminated with the second jet of oxygen. Such a torch can be made of two parts or of a piece of one single element.

It should be noted that the improvement in heating at the bottom of the groove associated with two jets of high pressure cutting oxygen has permitted to increase the cutting speed by 20% under cold condition and by 10% under hot condition, over the better known processes operating with a single jet.

The Applicant has set up as a goal to simultaneously solve three problems, namely:

Since the production of a cutting duct, in particular the manufacture of the Laval tuyère, is a determining element to obtain good performances (width of groove and cutting speed), this production is delicate and costly, because of the dimensions of the torches which are actually sold, and the invention aims at simplifying this operation.

On the other hand, the user must presently own two types of torches depending on whether he wishes to privilege the cutting speed (torches with two cutting jets) or the width of the groove (torches with single cutting jet), and the invention aims at combining these two functions into a same and single torch.

Finally, by experience, the life of a cutting torch directly depends, under normal conditions of use, on the life of the cutting duct. With the present designs, in cases where performance decreases are observed, after cleaning the torch, one must change the cutting block in the design with a single jet, or the entire torch in the design with two jets, and the invention aims at limiting the number of pieces to be changed. The object is therefore to realize another torch design, enabling to solve the three problems mentioned above, while preserving and even improving, the performances of the two processes and ensuring that the torch is industrially reliable.

SUMMARY OF INVENTION

The cutting torch according to the present invention, of the type including an oxygen cutting jet and a heating crown around said jet, is characterized in that it comprises a torch body having two ducts connected to a duct for feeding the cutting oxygen, said ducts ending in two housings which are aligned according to a diametrical axis, means opening at the level of one of said housings, called first housing, for feeding a fuel mixture, said torch body being associated with at least one set of three inserts, two of said inserts, called cutting inserts, being adapted for engagement, one in the first housing to close the opening of the fuel feeding means, and connected with the cutting oxygen duct, the other, in the second housing, the third insert being a supplementary heating nozzle adapted for engagement, in place of the first cutting insert, in the first housing to allow nozzle heating ducts to communicate with the means for feeding the fuel mixture.

In this manner, two versions of the torch can be used, namely a version with a single jet associated with a heating nozzle giving an outstanding capacity of surface heating immediately before the start of the cutting jet, while by proceeding to a simple removal of said heating nozzle and by engaging a cutting insert—which is located in front of the cutting jet of the initial cutting insert—, there is obtained, practically with the same essential components of the torch body, a torch with two cutting jets which is particularly fast.

According to a preferred embodiment, the torch body comprises two bodies engaged over one another, namely a so called core injector and injector head body with a stepped plurality of channels for feeding gaseous components, (heating oxygen, cutting oxygen, fuel gas), forming an abutting shoulder for a so called heating annular body, means for fixedly mounting said heating annular body on said injectors body core with predetermined angular orientation, said heating annular body incorporating longitudinal heating ducts in alignment with homologous ducts of the injectors head, which are connected on the one hand to a duct opening in a fuel feeding channel, on the other hand to a so called injector duct opening in a heating oxygen feeding channel, said means for feeding fuel mixture at the level of the first insert housing defining a transverse chamber supplied with a fuel mixture by means of longitudinal ducts each connected on the on hand to a duct opening in the fuel feeding channel and on the other hand to a so called injector duct connected to a heating oxygen feeding channel. The two part embodiment, known per se, is found here, however it is adapted to the new function of receiving removable and changeable cutting and/or heating inserts. The transverse chamber used for feeding a fuel mixture with a low content of oxygen, and therefore highly carburizing, enables on the one hand to complete the feeding of the heating nozzle which is partly carried out by means of a head including a duct for admitting so called cutting oxygen emerging in longitudinal nozzle heating ducts, and on the other hand to feed a carburizing fuel mixture to an inserted longitudinal duct provided between the two housing inserts.

BRIEF DESCRIPTION OF DRAWINGS

The characteristics and advantages of the invention will appear from the description which follows, given by way of example, with reference to the annexed drawings in which.

DESCRIPTION OF PREFERRED EMBODIMENTS

Figure 1:
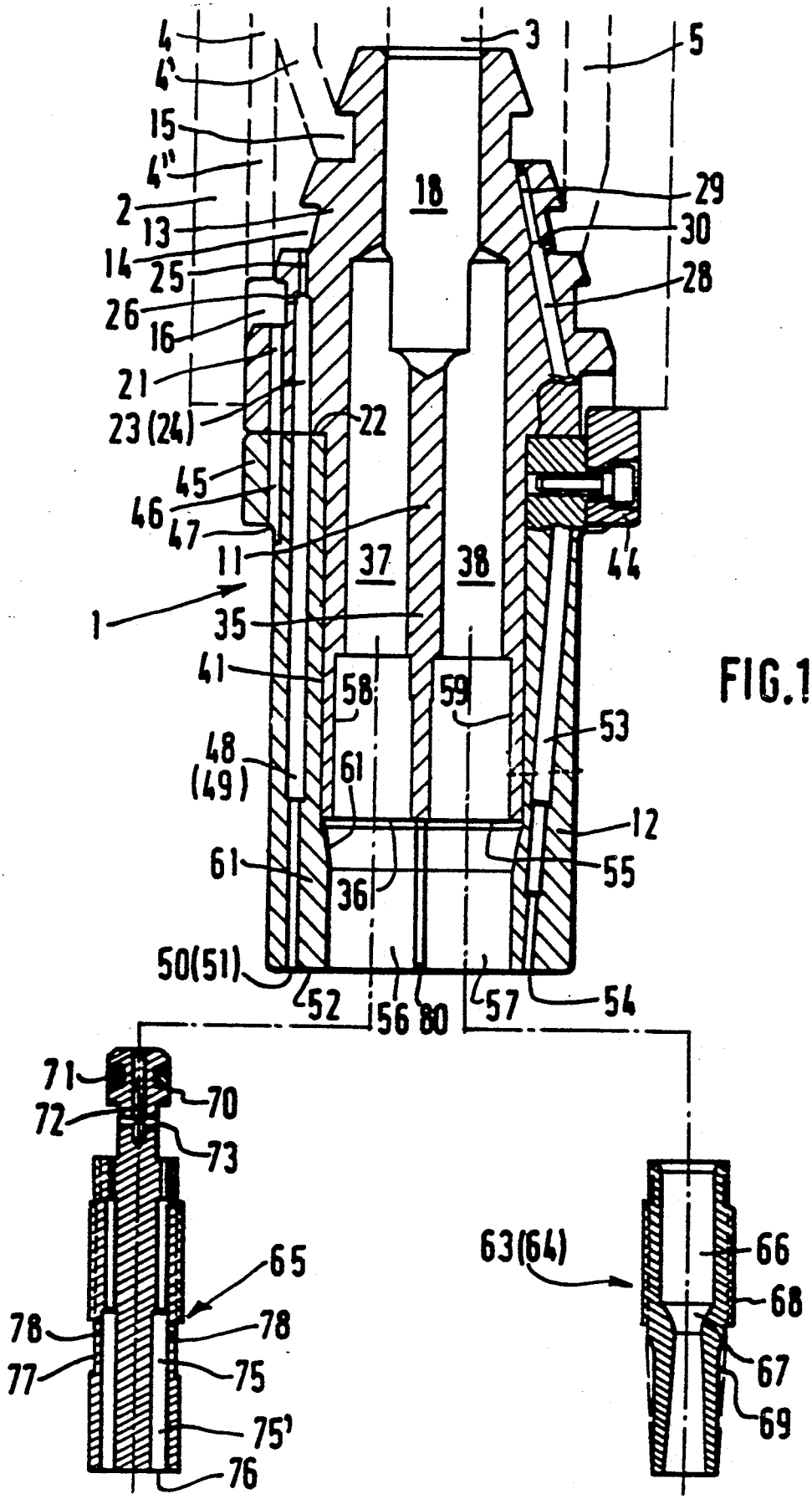
FIG. 1 is a cross-section view of the torch body with a heating nozzle and a cutting injector in non assembled position.
Figure 5:
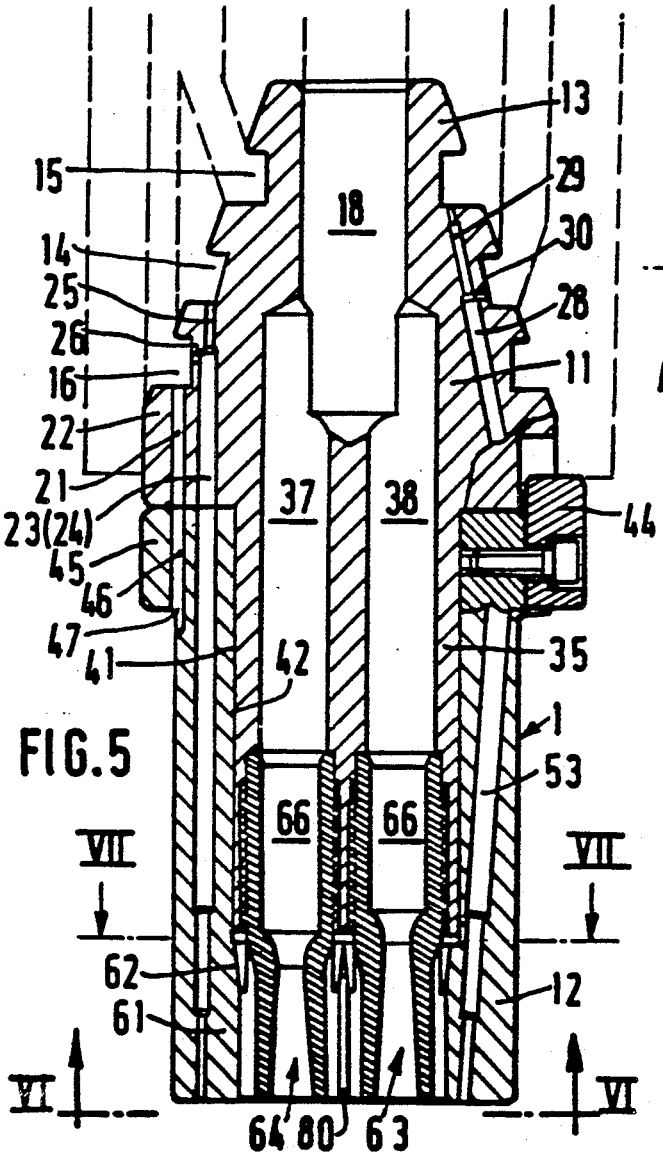
FIG. 5 is a cross-section view of the torch body according to FIG. 1, provided with two cutting injectors.
Figure 7:
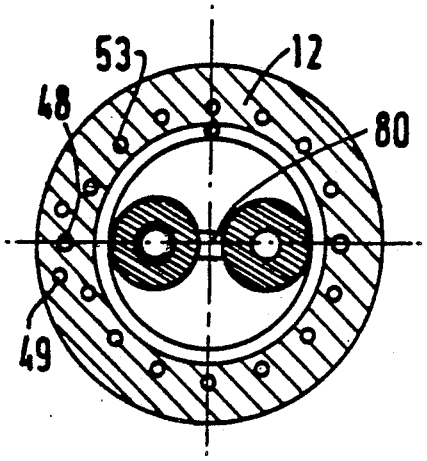
FIG. 7 is a transverse section according to line VII—VII of FIG. 5.
Figure 8:
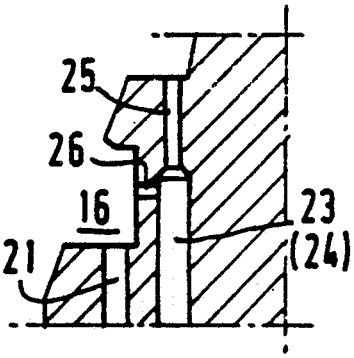
FIGS. 8 and 9 are detailed views in enlarged scale of FIGS. 5 and 3 respectively.
Figure 9:
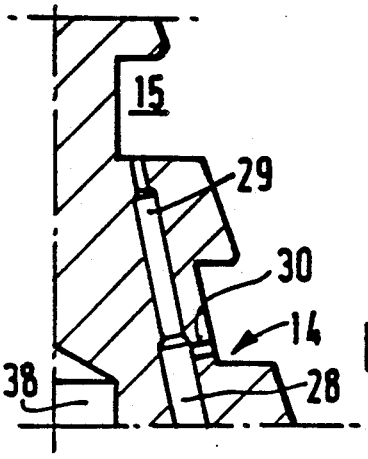
Figure 6:
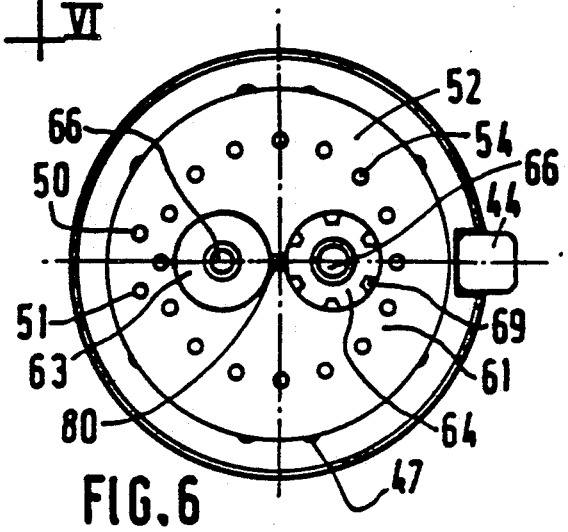
FIG. 6 is a front view according to line VI—VI of FIG. 5.
Figure 3:
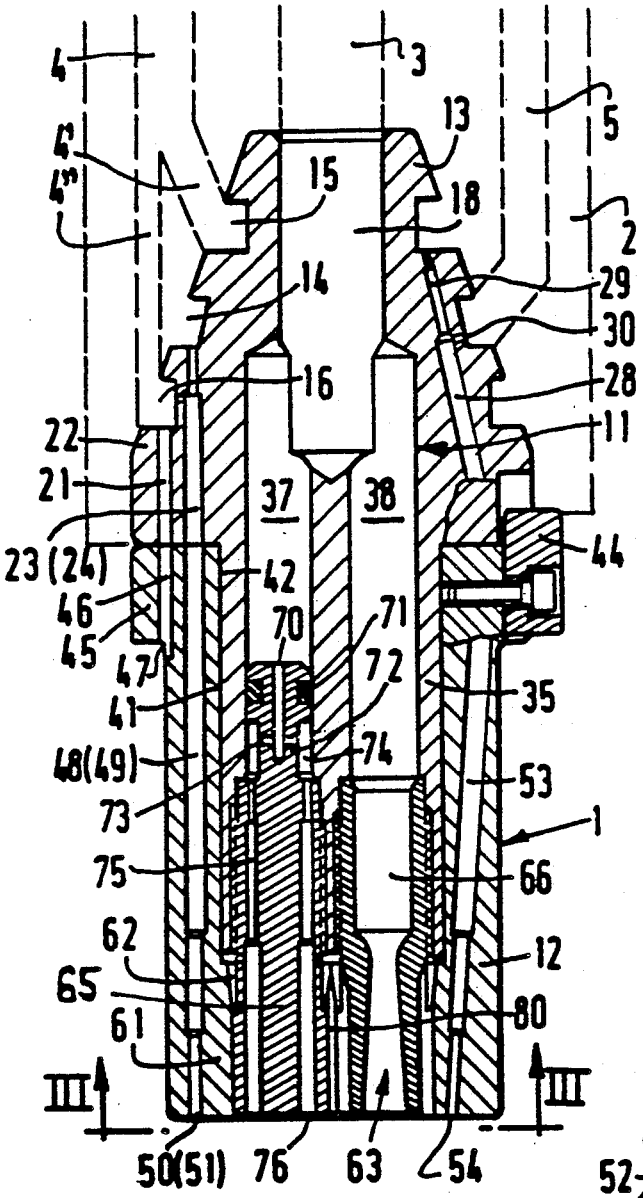
FIG. 3 is a view similar to FIG. 1, with the heating nozzle and the cutting injector in assembled position.

With reference to the annexed drawings, a cutting torch 1 is mounted on a blowtorch body 2 (represented in dotted line) and incorporating an axial cutting oxygen feeding duct 3, a heating oxygen feeding duct 4 subdivided into two ducts 4' and 4'', and a fuel feed duct 5.

The cutting torch comprises a central body called injectors body 11, on which a so called heating body 12 is mounted.

Figure 2:
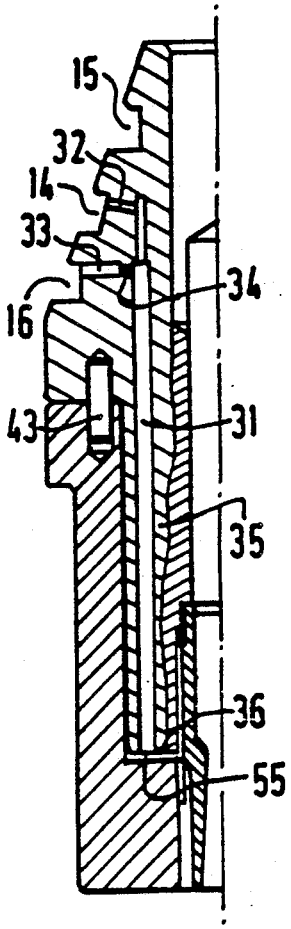
FIG. 2 is a partial half-view analogous to FIG. 1, with angular displacement.
Figure 4:
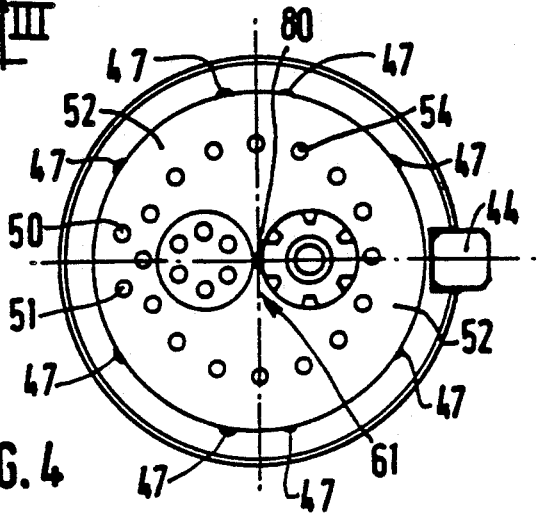
FIG. 4 is a front view according to arrows III—III of the torch according to FIG. 3.

The injectors body 11 comprises an upstream portion 13 of generally truncated shape adapted to be engaged in the body of the blowtorch 2 and having three axially stepped channels 14, 15, 16, of which channel 14, is opposite the opening of the fuel feed duct 5, thereby constituting an annular fuel distribution chamber 14, and in which the other two channels 15 and 16 are opposite respectively of the openings 4' and 4'' used for feeding heating oxygen thereby forming two heating oxygen annular distribution chambers 15 and 16 axially disposed on either side of the fuel chamber 14. A large axial duct 18 is opposite the opening of the cutting oxygen duct 3, while there appears, from the periphery towards the inside:

On the periphery, an annular plurality (eight in the drawings) of longitudinal so called cleaning ducts, originating from the transverse chamber for feeding heating oxygen 16, and all of them emerging through a shoulder 22 of the block of injectors 11;

two so called preheating longitudinal ducts 23 and 24 supplied with fuel via a duct 25 from the fuel chamber 14 and via a small injector duct 26 from the annular chamber of heating oxygen 16 and all of them emerging through a shoulder 22 of the block of injectors 11 (cf. FIGS. 1, 3, 5 and 8);

an annular plurality (sixteen in the drawings) of so called heating ducts 28 inclined towards the exterior and the downstream direction, supplied with oxygen by means of an injector duct 29 originating from the annular chamber of heating oxygen 15 and through a duct 30 from the annular chamber of fuel 14 and all of them opening through the shoulder 22 of the block of injectors 11;

inserted between certain ducts of the crown of heating ducts 28 are arranged (cf. FIG. 2) an annular plurality of carburizing heating ducts 31 connected via a duct 32 to the chamber for feeding fuel 14 via duct 33 to injector 34 from the chamber for feeding heating oxygen 16. These ducts of carburizing heating 31 are longitudinal and, contrary to the heating ducts 28, which are inclined towards the exterior, they open through the downstream shoulder 22, extend in an upstream portion in the form of a core 35 of the body of injectors 11 until they emerge through a terminal front face 36 of this body of injectors 11;

the cutting oxygen duct 18 is subdivided into two ducts 37 and 38, whose axes are in an average diametrical plan between the preheating ducts 23 and 24 and emerging through the front face 36.

The heating body 12 is the form of an annular member with, on the downstream side, an internal face 41 slidably mounted on the external face 42 of the core 35 of the body of injectors 11 until abutting against the shoulder 22 of this body of injectors 11, with a predetermined orientation by means of pins 43 with respect to the body of injectors 11, and by means of a key bolt 44 with respect to the body of the blowtorch 2. On the upstream side, the heating body 12 is closed into a massive member 61 past a cut annular skirt 62 whose most flared diameter is located at a small distance from the front face 36 of the block of injectors 11, so as to form a circular transverse channel 55 in which the heating carburizing ducts 31 open.

This heating body 12 has an outward radial collar 45 in which are provided longitudinal ducts 46 in the exact extension of the cleaning ducts 21 of the body of injectors 11 and emerging at 47. Similarly, two longitudinal preheating ducts 48 and 49 appear in the exact extension of the two preheating ducts 23 and 24 of the body of injectors 11 to open at 50 and 51 through the front transverse face 52 of the heating body 12. Similarly, heating ducts 53 centrally inclined towards the downstream direction, originate upstream and exactly opposite—not illustrated in the drawings—the outlet of the heating ducts 28 of the body of injectors 11, to emerge at 54 through the front face 52 of the heating body 12. The heating body 12 also has two large longitudinal perforations 56 and 57 which appear axially in the extension of the cutting oxygen ducts 37 and 38.

These perforations 56 and 57 as well as a flared terminal portion 58 and 59 of the ducts 37 and 38 serve as housings for a cutting insert 63, a second insert 64 or an insert defining a heating nozzle 65.

The cutting insert 63, or 64, has a large duct 66 with converging-diverging tuyère 67. On its outer face there is a thread 68 adapted for cooperating with a threading unit 59 of the housing at 58 and 59 and an annular plurality of longitudinal countersunk holes 69. In assembled position, (FIGS. 3 and 5), a cutting insert 63 (FIG. 3) or 63–64 (FIG. 5) is tightly screwed in a housing (57–59) and/or (56–58), the axial duct 66 being fed with cutting oxygen through duct 38 (FIG. 3) through ducts 38 and 37 (FIG. 5), while the countersunk holes 69 define with the wall of the housings 56 or 57 an annular crown of ducts 69 around the axial duct 66, connected upstream to the chamber of fuel mixture defined by the circular channel 55 which itself is fed by the ducts 31.

A heating nozzle 65 has a head 70 with sealed joint 71 and an axial duct 72 radially opening through ducts 73 in a channel 74 defining, when assembled, a chamber 74 for distributing oxygen (so called cutting) which is herein used as heating oxygen for a crown of longitudinal ducts 75, of increasingly large diameter until emerging at 76. The heating nozzle 65 has an annular narrowing 77 at the location of the transverse channel 55 and at this level, there are provided radial perforations 78, so that a downstream portion 75' of the ducts 75 is supplied with a fuel mixture.

It will be observed that between the housings 56 and 57 of the annular heating body 12 there is provided a groove 80 which defines a supplementary heating ducts with carburizing effect which is for example useful when the torch is provided with two inserts forming two cutting jets operating in succession, the intermediate heating thus obtained ensuring a resumption of heating in a mean or bottom zone of the groove formed by the first cutting jet 64.

It will be noted that in the two cases, heating before cutting is reinforced at 50 and 51 which represents the forward attack of the future cut.

On the other hand, it will be noted that the cutting jet 63 which acts alone after the heating nozzle (FIG. 3) or after the formation of the groove made by the cutting jet 64 (FIG. 5) will be reinforced by an annular crown of flames 69 supplied with a mixture also with carburizing effect.

The annular crown of jets of oxygen emerging at the outlet 47 of the ducts 46 at the level of the mounting nut of the torch is intended to prevent any definite connection between torch and nut which would normally result from projections of molten metal. The oxygen fed at this location ensures an instant burning, or at least a pushing away of the projection of molten metal.

We claim:

1. Cutting torch for iron and steel metallurgy including an oxygen cutting jet and a heating crown around said jet, wherein in that it comprises a torch body having two ducts connected to a duct for feeding cutting oxygen, said ducts ending in two housings which are aligned according to a diametrical axis, means opening at the level of one of said housings called first housing, for feeding a fuel mixture, said torch body being associated with at least one set of three inserts, two of said inserts, called cutting inserts, being adapted for engagement, one in the first housing to close the opening of the fuel feeding means, and to connect with the cutting oxygen duct, the other, in the second housing, the third insert being a supplementary heating nozzle adapted for engagement in place of the first cutting insert, in the first housing to allow nozzle heating ducts to communicate with the means for feeding the fuel mixture.

2. Cutting torch according to claim 1, wherein in that the heating nozzle comprises a head provided with a duct for introducing cutting oxygen emerging in said nozzle heating ducts.

3. Cutting torch according to claim 1, wherein in that the torch body comprises two bodies engaged over one another, namely a single core injectors and injectors head body, a stepped plurality of channels for feeding gaseous components, namely heating oxygen, cutting oxygen, fuel gas, forming an abutting shoulder for a so called heating annular body, means for fixedly mounting said heating annular body on said injectors body core with predetermined angular orientation, said heating annular body incorporating aligned longitudinal heating ducts in alignment with homologous ducts of the injectors head, which are connected on the one hand to a duct opening in a fuel feeding channel, on the other hand to a so called injector duct opening in a heating oxygen feeding channel, said means for feeding the heating nozzle with a fuel mixture defining a transverse chamber connected by means of fuel mixture feeding longitudinal ducts each connected on the one hand to a duct opening in the fuel feeding channel and on the other hand to a so called injector duct connected to a so called cutting oxygen feeding channel, used herein as heating oxygen.

4. Cutting torch according to claim 3, wherein in that the annular heating body extends axially past the core with a massive terminal portion having two ducts defining terminal portions of the insert housings, the terminal front face of the core being at a short distance from the inner bottom of the massive terminal portion of the annular heating body, so as to constitute a transverse annular channel defining said fuel mixture feeding chamber, in which emerge the longitudinally extending fuel mixture feeding ducts.

5. Cutting torch according to claim 4, wherein in that the longitudinally extending feeding ducts opening in the transverse channel between front core face and bottom of massive terminal portion of heating annular body are exclusively provided in the core of the body of injectors.

6. Cutting torch according to claim 1, wherein in that the cutting inserts and the heating nozzle are provided on a portion of their axial length with a thread cooperating with a threading corresponding to a housing.

7. Cutting torch according to claim 6, wherein in that the threadings are formed in the ducts housing of the core of the body of injectors.

8. Cutting torch according to claim 7, wherein in that a cutting insert has a converging-diverging cutting oxygen longitudinal duct.

9. Cutting torch according to claim 8, wherein in that a cutting insert has on a terminal axial length an annular crown of peripheric grooves.

10. Cutting torch according to claim 1, wherein by a set of cutting inserts having identical external mounting configurations and interior ducts of cutting oxygen of different diameters.

11. Cutting torch according to claim 1, wherein in that the heating nozzle has, past the mounting thread, a head extension of reduced cross-section with toroidal seal joint and an axial duct emerging in the radial ducts.

12. Cutting torch according to claim 11, wherein in that the heating nozzle comprises at an intermediate level a narrowing of its external diameter with the radial ducts each emerging in a longitudinal nozzle duct.

13. Cutting torch according to claim 12, wherein in that an inserted longitudinal duct is provided between the two insert housings of the massive terminal portion of the annular heating body, said duct originating at the level of the transverse feeding chamber.

14. Cutting torch according to claim 13, wherein in that the annular heating body has an outer radial extension which rests on an outer radial extension of the head of injectors of the body of injectors, with longitudinal ducts aligned through said extensions and emerging, in the head of injectors, in a heating oxygen feeding channel.

* * * * *